United States Patent [19]

Virta et al.

[11] Patent Number: 4,628,618

[45] Date of Patent: Dec. 16, 1986

[54] APPARATUS IN A DRYING SECTION OF A PAPER MACHINE

[75] Inventors: Raimo Virta, Turku; Martti Salmivaara, Littoinen, both of Finland

[73] Assignee: Valmet OY, Finland

[21] Appl. No.: 702,621

[22] Filed: Feb. 19, 1985

[30] Foreign Application Priority Data

Mar. 2, 1984 [FI] Finland ..... 840856

[51] Int. Cl.[4] ..... F26B 13/08

[52] U.S. Cl. ..... 34/116; 34/122; 34/123

[58] Field of Search ..... 34/116, 117, 120, 122, 34/123

[56] References Cited

U.S. PATENT DOCUMENTS

| | | | |
|---|---|---|---|
| 4,190,964 | 3/1980 | Schiel | 34/114 |
| 4,441,263 | 4/1984 | Vedenpaa | 34/116 |
| 4,502,231 | 3/1985 | Fissmann et al. | 34/116 |
| 4,516,330 | 5/1985 | Eskelinen | 34/117 |

FOREIGN PATENT DOCUMENTS

| | | |
|---|---|---|
| 2712184 | 9/1978 | Fed. Rep. of Germany . |
| 803891 | 12/1980 | Finland . |

*Primary Examiner*—Albert J. Makay
*Assistant Examiner*—David W. Westphal
*Attorney, Agent, or Firm*—Steinberg & Raskin

[57] ABSTRACT

In the drying section of a paper machine, apparatus for preventing conditions tending to deteriorate the contact between a web and a supporting fabric which carries the web from a drying cylinder in one line to a drying cylinder in another line and, in particular, for preventing a positive pressure from being generated in the narrowing gaps defined by the surfaces of the drying cylinders and the web supporting fabric as it approaches and/or moves away from the drying cylinder. The apparatus includes a blow box extending transversely substantially over the width of the web, the blow box including at least two transversely extending gas discharge slots between which a substantially planar carrying surface is provided in opposed, parallel relationship to the web carrying fabric and spaced a distance therefrom which is at least twice, and preferably ten to thirty times, as large as the width of a gas discharge slot.

20 Claims, 5 Drawing Figures

APPARATUS IN A DRYING SECTION OF A PAPER MACHINE

BACKGROUND OF THE INVENTION

The present invention relates generally to paper making machines and, more particularly, to apparatus for use in a drying section of a paper machine for preventing conditions which tend to deteriorate the contact between the web and a supporting fabric.

Specifically, the invention relates to apparatus for preventing the generation of positive pressures in the narrowing gaps defined by the surfaces of drying cylinders and the web supporting fabric as it approaches and/or moves away therefrom. The apparatus generally comprises a blow box which extends substantially over the entire width of the web and which is adapted to be connected to a source of blow air. The blow box is provided with at least two blow air discharge apertures, such as nozzle slots or the like, transverse to the direction of run, i.e., the longitudinal direction, of the web.

The running speeds of paper machines have in recent years been constantly increasing and are now approaching 1,500 meters per minute. The tendencies of the web to flutter and become loosened from supporting fabrics have therefore become serious problems in the operation of modern paper machines.

The present invention has particular applicability in connection with paper machine drying sections using so-called single-wire draws. In such drying sections a web in contact with a supporting fabric runs from a drying cylinder in one line of drying cylinders to a drying cylinder in another line of drying cylinders so that on the cylinders of one line the web is situated between the supporting fabric, i.e., the drying wire, and the surface of the cylinder, while on the cylinders of the other line the web is situated on the outside with the drying wire situated between the cylinder surface and the web. Such single-wire draw arrangements are advantageous in that the web is supported by the drying wire at all times without any open draw, or at least without any substantially lengthy open draw, thereby reducing the risks of wrinkles being formed in the web and of web breakage.

It is well known that a thin boundary layer of air follows the moving surfaces of the web supporting fabric with those particles of air which are in contact with the moving surface moving at the same speed as the fabric.

Narrowing gaps or throats are defined in single-wire draw drying sections by the surfaces of the drying cylinders or rolls and the web supporting fabric or wire. Such narrowing gaps are termed inlet gaps in the case where the web carrying fabric moves into or enters such a gap, and are termed outlet gaps when the web supporting fabric moves away from the gap.

If all of the surfaces defining the narrowing gap are substantially impervious to air, an air flow is produced between the boundary air layers, both in inlet and outlet gaps, in a direction opposite to the direction of the boundary air layer flows. Therefore, a positive pressure exists across the fabric in an inlet gap due to the dam-like effect of the boundary layer air flows. On the other hand a negative pressure exists across the fabric in outlet gaps due to the suction created by the boundary layer air flows.

When air pervious fabrics, such as wires, are used as is conventional, the pressure differential across the web supporting fabric, caused by the boundary layer air flows, usually causes a detrimental air flow through the fabric. Indeed, several so-called pocket ventilation devices have been proposed in the past which are based on the pumping effect of the open drying wires described above.

It is also conventional to provide the first and second drying groups of a paper machine with a single-wire draw, which is often arranged so that the paper web is situated between the wire and the cylinder on those cylinders of the upper line, while the drying wire is situated on the drying cylinder surface with the web situated over the wire on the drying cylinders of the lower line.

The operation of single-wire draws in drying sections of the type described above has given rise to numerous problems and drawbacks which directly result from the differences in pressure caused by the boundary layer flow at the different sides of the web supporting wire. Air tends to flow from the higher pressure side to the lower pressure side through the wire and thereby tends to loosen the support contact between the wire and the paper web. In particular, such problems arise in the regions of the narrowing inlet and outlet gaps, in both of which the pressure differential across the wire tends to detach the paper web from the supporting wire. If such detachment occurs, the paper web will behave in an unstable manner due to the air flows which occur in the pockets defined between the drying cylinders. A web that has become loosened from its supporting wire is often lengthened on the lower drying cylinders under the effects of centrifugal force, which in turn results in wrinkling of the web in an inlet gap. In the worst case, the web can break which necessitates shutting down the operation of the entire paper machine.

In an attempt to overcome the problems described above, various sealing arrangements have been suggested whose objective is to prevent the boundary layer air flow from following the moving surfaces of the web supporting fabric and the drying cylinder into the narrowing gap defined thereby. For example, such a sealing arrangement is disclosed in patent application DE-OS No. 2,712,184. Such mechanical sealing arrangements are limited in that they cannot be located sufficiently close to the moving web or fabric due to the risk of damage to the web and the risk of abrasion to the wire. For example, it is not possible to seal a narrowing outlet gap by mechanical means of this type since moving paper web requires a distance of at least 10 mm from the sealing member. Although it is theoretically possible to situate a mechanical seal closer to the fabric in the case of a narrowing inlet gap, such a provision only shifts the point at which the pressure differential exists to a location ahead or upsteam of the seal where a positive pressure caused by the damming effect of the boundary layer flow is then produced.

Conventional mechanical seal arrangements also have the drawback that the efficiency of these seals deteriorates over the course of time if the seals are located so close to the surfaces that abrasion takes place. In patent application FI No. 803891, assigned to the assignee of the instant application, a method and apparatus are suggested for preventing the formation of positive and negative pressures which would be detrimental to the supporting contact between the fabric and the web. The device disclosed in that application is situated proximate to the initial line of contact between the surfaces of the drying cylinder and the web supporting wire. This device improves the support contact between the wire and the web in a region from the initial line of contact (or ultimate line of contact) to a region situated about 200 to 300 mm from the line of initial or ultimate contact between the wire and the web which is, as a rule, sufficient in a group of drying cylinders of modern paper machines.

However, there may be free draws between the rolls or cylinders of two drying groups which are so long that the range of 200 to 300 mm of improved support contact achieved by the apparatus disclosed in application FI No. 803891 is not sufficient, whereby the web tends to become loosened from the supporting wire or fabric and flutters.

Indeed, in single-wire draw drying sections, the support contact between the web and the wire is not deteriorated solely by the positive pressures generated in the narrowing gaps or throats, the effects of which extend only over a relatively short distance. Rather, the contact between the web and the supporting fabric or wire is also deteriorated due to the instability and fluttering of the run of the web supporting fabric which occurs over the relatively long, free runs thereof between drying cylinders of the upper and lower lines of drying cylinders.

SUMMARY OF THE INVENTION

Accordingly, it is an object of the present invention to provide new and improved apparatus for use in a drying section of a paper machine for preventing conditions which tend to deteriorate the support contact between the web and a fabric supporting the same.

Another object of the present invention is to provide new and improved apparatus for use in a drying section of a paper machine for preventing the generation of positive pressures in the narrowing gaps defined by the surfaces of the drying cylinders and the web supporting fabric as it approaches and/or moves away therefrom.

Still another object of the present invention is to provide new and improved apparatus for use in a drying section of a paper machine for preventing generation of positive pressures in such narrowing gaps and whose effect extends over a remarkably large distance from the line of initial or ultimate contact between the web carrying fabric or wire and the cylinder.

A further object of the present invention is to provide new and improved apparatus which in addition to preventing generation of positive pressures in the narrowing gaps can be extended well beyond the area in which a positive pressure would be generated and, thereby, function to stabilize the free runs of the web carrying wire to prevent fluttering thereof and in this manner improve the support contact of the web and wire over such free runs.

Yet another object of the present invention is to provide new and improved apparatus for use in a drying section of a paper machine which improves the support contact between the web and a web carrying wire which is of simple construction, which will not cause undue abrasion and which will not cause any damage to the moving wire or fabric.

Briefly, in accordance with the present invention, these and other objects are attained by providing a blow box in conjunction with a run of the web supporting fabric and extending transversely thereto substantially over the width of the web. The blow box includes at least two gas discharge aperture means between which a substantially planar carrying surface is provided in opposed, substantially parallel relationship to the web carrying fabric. The planar carrying surface is spaced at a distance from the web carrying fabric which is at least twice as large as the width of at least one of the gas discharge aperture means.

It is preferable that the distance at which the planar carrying face is spaced from the web carrying wire be in the range of between about 10 to 30 times, and most preferably in the range of between about 15 to 25 times, as large as the width of one of the transverse gas discharge aperture means which is situated in proximity to the web carrying drying wire.

By providing that the planar carrying surface of the blow box be spaced at the distance from the opposed web carrying wire as set forth above, it is insured that the space defined between the carrying surface and the opposed web carrying wire has a sufficiently large flow section so that a sufficiently large level of negative pressure can be maintained in connection with the carrying surface. In particular, a negative pressure is generated in the space by means of a so-called ejection effect caused by the jets of blow gas discharged from the gas discharge aperture means. The jets of blow gas discharged from the discharge aperture means entrain or suck air out from the space between the carrying surface and the web carrying wire to thereby create a negative pressure in the space.

In this connection it should be emphasized that apparatus in accordance with the invention does not promote the support contact between the web and the drying wire exclusively by preventing positive pressures from being generated in the narrowing gaps or throat regions defined by the surfaces of the drying cylinders and the web supporting fabric. Rather, if required, the apparatus may be provided over the free runs of the web supporting wire to extend over a sufficiently long distance so that the run of the web supporting wire itself is stabilized so that the support contact between the web and the wire is also improved in that manner. Indeed, the planar carrying surface of the blow box can be extended in accordance with the invention so as to substantially cover the entire length of the free runs of the web carrying wire between the drying cylinders of the upper and lower lines in a drying group.

The carrying surface of the blow box is preferably substantially planar and parallel to the web carrying wire with which it is in opposed relationship. The carrying surface is defined at its longitudinal ends by the gas discharge aperture means and at its transverse ends at the edges of the carrying surface, by side walls which extend parallel to the direction of run of the web. The side walls may be provided with gas discharge aperture means through which jets of blow gas can be directed to prevent any leakage flow which would otherwise take place through the space between the web carrying wire and the top edges of the side walls and which would tend to reduce the negative pressure which exists in the space between the carrying surface of the blow box and the opposed web carrying wire.

The apparatus of the invention is most effectively used in the narrowing gaps formed by drying cylinders whose surfaces are contacted by the drying fabric or wire with the web on the outside, i.e., which are defined by the drying cylinder surface and the drying wire.

Apparatus in accordance with the invention may be used, for example, in the first and second drying groups of a paper machine in all or only in some of the narrowing gaps in which positive pressure would be generated or, in the case where a single-wire draw is used in mor than the first two drying groups, use of the apparatus of the invention may be extended so as to be used within areas of more than two drying groups.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
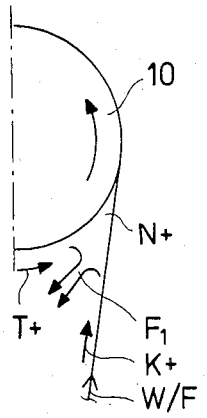
FIG. 1 is a schematic illustration showing the formation of positive pressure in a narrowing gap defined by the surface of a drying cylinder and a web supporting wire in the case where the web supporting wire combination is relatively impervious to air.

Referring now to the drawings wherein like reference characters designate identical or corresponding parts throughout the several view, and more particularly to FIG. 1, a web supporting wire W/F which is impervious to air approaches and arrives on a drying cylinder 10 whereby the surface of the drying cylinder 10 and the web carrying wire W/F define a narrowing gap N+ between them. A positive pressure is generated in the narrowing gap N+ by the effect of the boundary layer flows T+ and K+. Such positive pressure causes a flow out of the narrowing gap, designated $F_1$.

Figure 2:
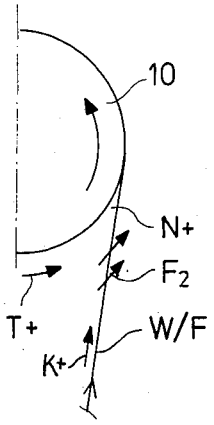
FIG. 2 is a view similar to FIG. 1 showing the case where the web supporting wire combination is relatively pervious to air.

FIG. 2 is a similar arrangement as that shown in FIG. 1 with the exception that a drying wire F which is pervious to air is used. The positive pressure generated in the narrowing gap N+ by the boundary layer flows T+ and K+ causes an air flow $F_2$ through the web supporting wire combination W/F due to the pressure differential thereacross.

Figure 3:
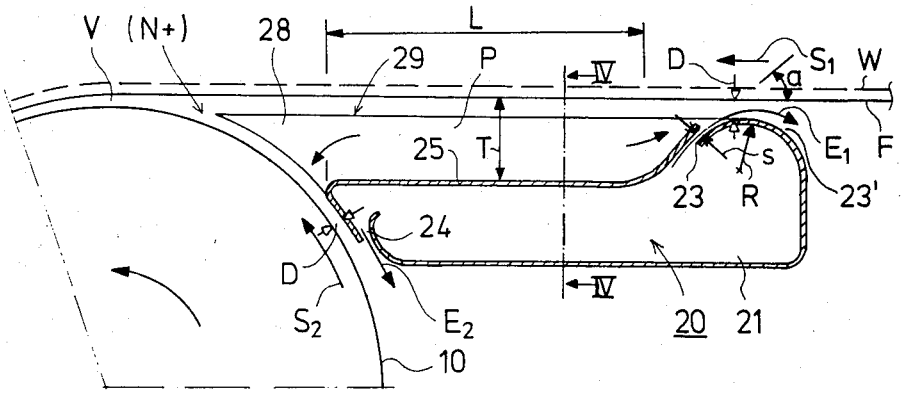
FIG. 3 is a vertical sectional view of apparatus in accordance with the invention situated in a narrowing gap defined by the surface of a drying cylinder and a drying wire in which the web carrying wire combination has a relatively long free draw before reaching the drying cylinder.

Referring now to FIG. 3, an apparatus in accordance with the invention, generally designated 20, is illustrated. Apparatus 20 is located in the narrowing gap N+ defined by the surface of drying cylinder 10 and the drying wire F which carries web W. Apparatus 20 comprises a blow box 21 provided with two blow gas discharge aperture means, in the form of nozzle slots 23 and 24, which extend transversely to the direction of run of web W over substantially the entire width of the web. Blow box 21 is adapted to be connected to a source of blow gas, such as pressurized air. The air jet $E_1$ discharged from the first nozzle slot 23 is directed in a direction opposite to the direction of run $S_1$ of the wire F facing the nozzle slot 23. The air jet $E_2$ discharged from the second nozzle slot 24 is directed in a direction opposite to the direction $S_2$ in which the surface of the cylinder 10 is moving. A substantially planar carrying surface 25 is provided between nozzle slots 23 and 24. Carrying surface 25 is situated in opposed substantially parallel relationship to the web carrying wire F to define a space P therebetween.

According to the invention, the distance T at which the carrying surface 25 is spaced from the wire F is at least twice as large as the width s of nozzle slot 23 and/or 24. In this manner it is ensured that the flow sections of space P at negative pressure related to the carrying surface 25 are sufficiently large and the flow resistances sufficiently low so that a negative pressure can be maintained in connection with the carrying surface 25 by means of the ejection effects of the blow air jets $E_1$ and $E_2$, and possibly $E_3$ (discussed below) that the effects of the positive pressure otherwise created in the narrowing gap are eliminated.

The distance T of the carrying surface 25 from the wire F is generally within the range of between about 10 to 30 times the width s of the nozzle slot 23 or nozzle slot 24, and most preferably in the range of between about 15 to 25 times as large, although it is understood that the beneficial effects of the invention can be obtained by providing that the distance T be at least twice as large as the nozzle slot width s. The length L of the carrying surface 25 in the direction of web run can be freely chosen in accordance with the length over which the support contact between the web W and the wire F is desired to be improved thereby avoiding the drawbacks occurring in the prior art, namely, the improvement of web support contact only in the localized region of the narrowing gap.

The width s of nozzle slots 23 and 24 is generally within the range of between about 1 to 10 mm and, most preferably in the range of between about 2 mm to 5 mm. The length L of the carrying surface 25 is generally greater than about 300 mm and usually within the range of between about 500 mm to 1,000 mm. In some cases the carrying surface 25 may extend substantially over the entire length of the runs of the web W and wire F between drying cylinders 10.

Air jets $E_1$ and $E_2$ discharged from nozzle slots 23 and 24 suck or entrain air by means of a so-called ejection effect out of the space P between the carrying surface 25 and the wire F so that in this manner a negative pressure is produced in space P. Since the wire F is at least to some extent pervious to air but the web W is substantially impervious to air, the web W is sucked into contact with the wire F more firmly than has been possible heretofore.

The effect of improved support contact between the web W and the wire F or other suport fabric obtained by means of apparatus 20 in accordance with the invention extends from the nozzle slot 23 up to the contact line V between cylinder 10 and wire F.

Due to the negative pressures which exists in the space P, there is a tendency for a leakage air flow to occur into the space P through the gaps formed between the longitudinally extending transverse edges of carrying surface 25 and wire F. Such leakage air would reduce the negative pressure in space P and thereby reduce the effectiveness of the invention. It is therefore advantageous to provide means for reducing any leakage air flow into the space P.

Figure 4:
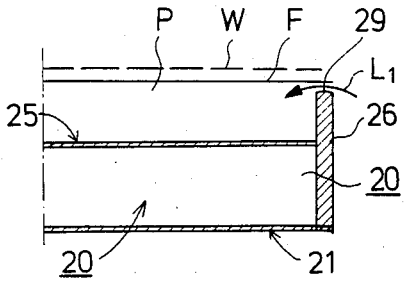
FIG. 4 is a sectional view taken along line IV—IV of FIG. 3.
Figure 5:
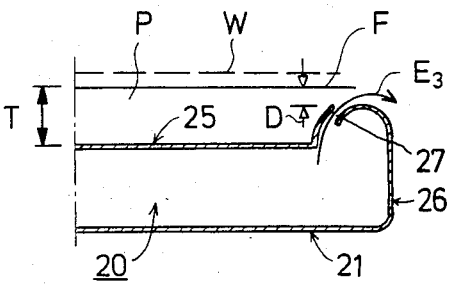
FIG. 5 is a view similar to FIG. 4 showing an alternative embodiment.

Referring to FIGS. 4 and 5 two embodiments of apparatus 20 of the invention are illustrated by means of which leakage flow $L_1$ at both edges of the wire F can be reduced or even prevented. In the embodiment of FIG. 4, the space P, in which a negative pressure is maintained, is closed by means of side walls 26 which extend upwardly at the side regions of the planar carrying surface to bound the same. The side walls 26 are made of appropriate plastic material which will not damage the wire F even if the wire F contacts the side walls 26. The top edges 29 of side walls 26 are preferably slightly rounded in order to prevent any detrimental effects of possible contacts between the top edge 29 and the wire F.

In the embodiment shown in FIG. 5, leakage flows $L_1$ from the edges of the wire F are entirely prevented by means of air jets E3 discharged from nozzle slots 27, the air jets $E_3$ being directed in an opposite direction to the direction in which the leakage flows $L_1$ would flow.

The nozzle slots 27 are situated proximate to the wire F at its edges at a distance D therefrom which is substantially the same as the distance D that nozzle slot 23 is spaced from wire F. The distance D is generally in the range of between about 10 to 20 mm and preferably about 15 mm so that there is no contact of the wire F with nozzles 27.

In the embodiments of FIGS. 4 and 5 and as best seen in FIG. 3, the narrowing gap N+ formed by the drying cylinder 10 and the wire F is closed at both edges of the wire F by means of wedge-shaped portions 28 of side walls 26, wedge-shaped portions 28 being shaped in accordance with the shape of the narrowing gap N+. Alternatively, wedge-shaped plates can be attached to the blow box.

In FIG. 3 the run of the web supporting wire F/W is illustrated as being horizontal before the narrowing gap N+ for the sake of simplicity. Generally, the run of the web carrying wire W/F prior to the narrowing gap N+ is substantially vertical as illustrated in FIGS. 1 and 2 and it will be understood that the apparatus 20 in accordance with the invention is located in an analogous manner in such a case.

As shown in FIG. 3, the initial direction of the blowing air jet $E_1$ discharged from nozzle slot 23 which is situated proximate to the wire F is at an angle a relative to the plane of the opposed wire F. The magnitude of angle a is smaller than about 70° and, preferably, in the range of between about 20° to 50°. The direction of the blowing air jet $E_2$ discharged from nozzle slot 24 is substantially parallel to a plane tangent to the surface of drying cylinder 10.

In connection with nozzle slot 23, there is a curved nozzle surface 23 having a radius of curvature R which acts as a so-called Coanda surface to guide the air jet $E_1$. The radius of curvature of the nozzle surface 23 is usually chosen so that the ratio of the radius of curvature R to the width s of nozzle slot 23 is greater than about 5. The guide surface 23' is also preferably formed such that it extends to a "lower" level than the nozzle slot 23. The curve guide surface 23' guides the air jet $E_1$ so that it preferably is turned slightly downwardly relative to the plane of the wire F as illustrated in FIG. 3.

It is understood that even though gas discharge aperture means 23 and 24 have been described hereinabove as comprising unitary nozzle slots, the discharge means can be formed by corresponding sets of nozzle apertures or by other nozzle arrangements.

The blow box 21 is connected with a source of pressurized air, known per se, by which the pressurized air is introduced into the interior of the blow box 21 and from which it is discharged through the nozzle slots 23 and 24, and through nozzle slots 27 where applicable. In connection with nozzle slots 27, it is advantageous to provide a corresponding inclination to the initial direction of the air jet $E_3$ relative to the plane of the wire F as described above in connection with nozzle slot 23.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a drying section of a paper machine including at least one drying group wherein a web in contact with a supporting fabric runs from a drying cylinder in one line of drying cylinders to a drying cylinder in another line of drying cylinders, apparatus for preventing conditions tending to deteriorate the support contact between the web and the fabric including the generation of positive pressures in the narrowing gaps defined by the surfaces of the drying cylinders and the web supporting fabric as it approaches and/or moves away therefrom, comprising:

at least one blow box adapted to be connected to a source of blow gas, said blow box being situated adjacent to a respective run of the web supporting fabric and extending transversely thereto substantially over the width of the web, said blow box including at least two transversely extending blow gas discharge aperture means having respective widths and between which a substantially planar carrying surface is provided, said carrying surface being in opposed substantially parallel relationship to the web carrying fabric and spaced a first distance therefrom which is in the range of between about 10 to 30 times the width of at least one of said blow gas discharge aperture means, a space being defined between said carrying surface and the opposed web carrying fabric, at least one of said blow gas discharge aperture means being situtated proximate to the web carrying fabric and spaced a second distance therefrom, said first distance at which said carrying surface is spaced from said web carrying fabric being greater than said second distance at which said at least one blow gas discharge aperture means is spaced from said web carrying fabric, and wherein said blow gas discharge aperture means comprise means for directing blow gas away from said space defined between said carrying surface and opposed web carrying fabric to generate a negative pressure in said space.

2. The combination of claim 1 wherein said first distance by which said carrying surface is spaced from said web carrying fabric is in the range of between about 15 to 25 times the width of at least one of said blow gas discharge aperture means.

3. The combination of claim 1 wherein the width of said at least one of said blow gas discharge aperture means is within the range of between about 1 mm to 10 mm.

4. The combination of claim 3 wherein the width of said at least one of said blow gas discharge aperture means is within the range of between about 2 mm to 5 mm.

5. The combination of claim 1 wherein the drying section includes at least two drying groups of drying cylinders and wherein at least one blow box is provided in each of said drying groups.

6. The combination of claim 1 wherein a respective blow box is situated in a respective narrowing gap defined by the surface of a drying cylinder and the web supporting fabric, in which narrowing gap a positive pressure would normally be generated.

7. The combination of claim 6 wherein a plurality of blow boxes are situated in a plurality of respective narrowing gaps.

8. The combination of claim 1 wherein said substantially planar carrying surface has a pair of longitudinally extending side regions and side walls provided at each respective side region bounding said carrying surface and extending towards respective edge portions of said web carrying fabric.

9. The combination of claim 8 wherein each of said side walls has a top edge facing the web carrying fabric and spaced therefrom a distance of between about 10 mm to 20 mm.

10. The combination of claim 8 wherein said top edge of each of said side walls is spaced from the web carrying fabric a distance of about 15 mm.

11. The combination of claim 8 wherein each of said side walls has a top edge facing the web carrying fabric and spaced in a substantially constant distance therefrom.

12. The combination of claim 11 wherein each of said top edges is rounded in a transverse direction.

13. And combination of claim 8 wherein a space is defined between said substantially planar carrying surface the the opposed web carrying fabric and wherein said blow gas discharge aperture means comprise means for directing blow gas away from said space to generate a negative pressure in said space, and wherein side blow gas discharge aperture means are provided in each of said side walls for preventing leakage flow of air into said space which would tend to reduce the level of negative pressure therein.

14. The combination of claim 8 wherein each of said side walls includes a wedge-shaped portion which extends to the extent possible into a narrowing gap defined by the surface of a drying cylinder and the web supporting fabric, in which narrowing gap a positive pressure would normally be generated.

15. The combination of claim 1 wherein said one of said blow gas discharge aperture means which is situated proximate to said web carrying fabric comprises means for directing blow gas towards said web carrying fabric at an angle thereto less than bout 70°.

16. The combination of claim 15 wherein said angle is in the range of between about 20° to 50°.

17. The combination of claim 1 wherein said blow box includes a curved surface extending from said one of said aperture means situated proximate to said web carrying fabric, said curved surface extending in the direction in which gas is blown therefrom, said blown gas following said curved surface due to the Coanda effect.

18. The combination of claim 17 wherein said curved surface has a trailing end situated at a level below the level of said one of said blow gas discharge apertures.

19. The combination of claim 17 wherein the ratio of the radius of curvature of said curved surface to the width of said one of said blow gas discharge apertures is greater than about 5.

20. The combination of claim 1 wherein one of said blow gas discharge aperture means comprise means for directing blow gas in the direction substantially parallel to a plane tangential to a surface of a drying cylinder and the other of said blow gas discharge aperture means comprise means for directing blow gas partially towards said web carrying fabric and in a direction opposite to the direction of run of said web carrying fabric.

* * * * *